US005410768A

United States Patent [19]

Manson et al.

[11] Patent Number: 5,410,768

[45] Date of Patent: May 2, 1995

[54] METHOD AND APPARATUS USEFUL FOR THE MAINTENANCE OF BLOOD CIRCULATION

[76] Inventors: Lewis A. Manson, 2222 Westerland, Suite 1, Houston, Tex. 77063; Russell C. Chase, 6626 Guhn Rd., Houston, Tex. 77429

[21] Appl. No.: 6,428

[22] Filed: Jan. 21, 1993

[51] Int. Cl.[6] ..... A61G 7/00

[52] U.S. Cl. ..... 5/609; 601/90; 60/581; 5/509.1; 5/607

[58] Field of Search ..... 5/607, 609, 108, 109, 5/509.1; 128/33, 38, 40; 60/581; 92/138; 601/24, 49, 90, 98, 100

[56] References Cited

U.S. PATENT DOCUMENTS

| | | | |
|---|---|---|---|
| 995,423 | 6/1911 | Ellis | 92/138 |
| 1,130,959 | 3/1915 | Campbell | 92/138 |
| 2,472,647 | 6/1949 | Covins | 92/138 X |
| 3,818,808 | 6/1974 | Shafer | 92/138 |
| 4,080,673 | 3/1978 | Weisler | 5/609 X |
| 4,114,209 | 9/1978 | Sandlin | 5/609 X |
| 4,152,795 | 5/1979 | Rodosta et al. | 5/609 X |
| 4,463,662 | 8/1984 | Okuyama | 92/138 X |
| 4,490,867 | 1/1985 | Gabrielsson | 5/609 |
| 4,654,903 | 4/1987 | Chubb et al. | 5/607 |
| 5,000,077 | 3/1991 | Habicht | 92/138 X |
| 5,042,097 | 8/1991 | Fuchs | 128/33 X |
| 5,044,029 | 4/1990 | Vrazlik | 5/453 |
| 5,103,511 | 4/1992 | Sequin | 5/609 X |
| 5,142,719 | 9/1992 | Vrazlik | 5/609 |
| 5,152,024 | 10/1992 | Chrones et al. | 5/609 |
| 5,181,288 | 1/1993 | Heaton et al. | 5/609 X |

*Primary Examiner*—Michael F. Trettel
*Attorney, Agent, or Firm*—John R. Casperson

[57] ABSTRACT

A method for preventing bedsores is disclosed which includes rocking the patient slowly at a rocking cycle period in the range of 1 to 120 minutes. Preferably, the entire bed is rocked using a hydraulic system characterized by synchronous motion of the master cylinders and the slave cylinders at the desired rocking cycle period. A pump is disclosed characterized by 4 master cylinders for conducting the rocking. The system constitutes an attachment for a bed such as hospital bed.

19 Claims, 3 Drawing Sheets

FIG. 8
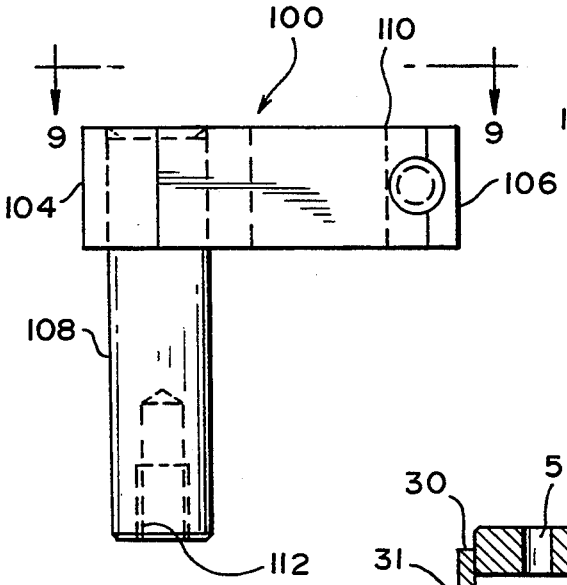
FIG. 9
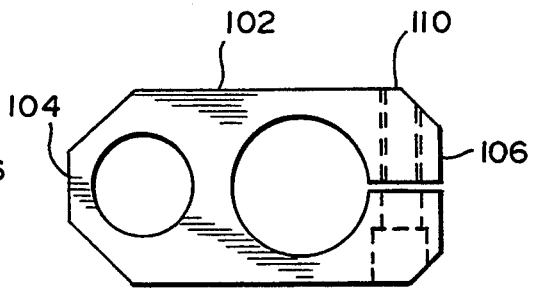
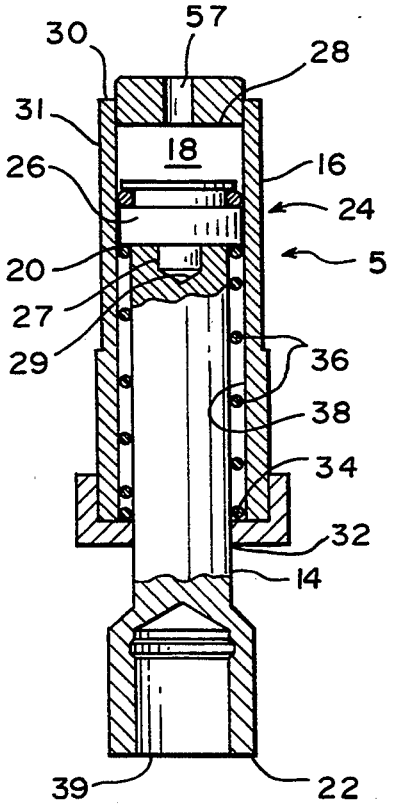
FIG. 10

METHOD AND APPARATUS USEFUL FOR THE MAINTENANCE OF BLOOD CIRCULATION

BACKGROUND OF THE INVENTION

In one aspect, this invention relates to therapeutic beds. In another aspect, this invention relates to an attachment for beds to provide a periodic reduction in pressure on body pressure points to aid in maintaining good circulation. In a further aspect, this invention relates to a method for maintaining good blood circulation. In yet another aspect, this invention relates to a pump which can be used with the just described method and apparatus.

Patients in frail health, whether in hospitals, or in nursing homes, or at home, require periodic turning to relieve pressure on body parts to prevent bed sores caused by patient inactivity and resulting curtailment of blood circulation. Such periodic patient turning consumes a great amount of time of the attending medical personnel. The patient turning operation also disturbs patient's sleep and rest. Various devices have been proposed to make the task of turning easier. U.S. Pat. No. 4,520,337, for example, discloses a special mattress pad to make it easier to turn the patient.

Kinetic therapeutic tables which slowly rotate patient support to vary the patient body parts to support his weight and alleviate bed sores are also known. Some examples of such therapeutic tables are U.S. Pat. Nos. 2,076,675 of Sharp; 2,950,715 of Brobeck; 3,434,165 of Keane; 3,748,666 of Seng; 4,107,490 of Keane; 4,175,550 of Leininger et al. and 4,277,857 of Syehaug.

In using such therapeutic tables the patient's body is tilted. It then becomes necessary to provide lateral support to prevent the patient from falling off the table. In the table of Keane U.S. Pat. No. 3,434,165, elongate, upstanding side members provide lateral support. Sometimes it is also necessary to provide means to restrain the patient knee and foot against movement to prevent injury to these body parts. The amount of movement in such devices is so extreme that it can interfere with a patients rest. Clearly a therapeutic bed which does not require restraining the patient or movements of the patient to such an extent that it interferes with their rest would be very desirable.

In some of known tables, in addition to rotary motion about an elongate axis, pivot or tilt motion about a transverse axis is also provided. Devices which provide for this type of movement for a patient support are known as illustrated by U.S. Pat. Nos. 2,076,675 of Sharp; 3,434,165 of Keane; 3,525,308 of Koopmans et al. and 4,277,857 of Syehaug. In Sharp U.S. Pat. No. 2,076,675 and Keane U.S. Pat. No. 3,325,308 the beds also rotate. In Chrones U.S. Pat. No. 5,152,024 an improved control system is provided to alleviate some of the problems of prior art but the table remains a cumbersome design and is quite expensive due to its elaborate features. Also, these devices are very complicated and require training and supervision to function properly. It is clear that a means for providing a therapeutic bed in an inexpensive and portable manner would be very desirable. A device which does not require adjustment, fixing, laundering, changing, adapting, or complicated instructions would be of benefit to a great many people.

The mechanical design and control systems of the aforementioned tables require quite elaborate features which result in expensive tables yet do not afford complete body blood circulation improvements. The complicated designs of these tables make the maintenance expensive. Many of the designs aid only portions of a persons body. Many of them require a facility to buy entire beds, special mattresses or other accessories. A device that would periodically take the weight off all of the pressure points of the body would clearly be a great advance. An attachment for existing hospital-type beds would be a blessing.

OBJECTS OF THE INVENTION

An object of the claimed invention is to eliminate bedsores using existing hospital, nursing home or even home beds.

Another object of the invention is to provide means attachable to any hospital, nursing home bed or even home bed that provides the necessary motion to constantly assure adequate blood flow to every part of the body.

A further object of the invention is to provide the necessary movement to assure blood flow to every part of the body in such a way that the person is relatively unaware that it is occurring.

Another object of the invention is to provide the necessary motion without interfering with access to the patient as is obtainable with a common hospital bed.

Another object of the invention is to provide a device that is very inexpensive as compared to a complete hospital bed and is very simple to use . . . just turn it on.

SUMMARY OF THE INVENTION

In accordance with one embodiment of the invention, there is provided a method for maintaining complete blood circulation in a resting person. The method is practiced by slowly rocking the person. The rocking motion is cyclic. The cycle period selected is generally in the range of from about 1 minute to about 120 minutes. The rocking motion is natural and peaceful. We call it "Ocean Motion." When the cycle period is less than about 1 minute, it tends to be excessively disturbing. When the cycle period is longer than about 120 minutes, the risk of developing bed sores becomes unacceptably high. In between these limits, the quiet, slow rolling motion (as a ship at sea) guarantees peaceful, restful sleep and the patient's body is continuously and gently self massaged.

In accordance with another embodiment of the invention, there is provided an apparatus for rocking a bed. The apparatus includes a means for raising and lowering one side of the bed. A means is provided for repeatedly simultaneously actuating the means for raising and lowering the side of the bed. The actuating means provides each complete cycle of raising and lowering with a cycle period of between about 1 minute and about 120 minutes in duration. This assures that pressure is periodically taken off all the pressure points and blood circulation maintained.

This embodiment of the invention can be used with most any bed and provides an inexpensive and removable attachment which will prevent bedsores. We call it the "Cradle" although any other name can be applied to it. The Cradle assures constant blood flow to all areas of the body. It can be used in any home by anyone—in hospitals, convalescent homes—nursing homes for the elderly. It is not necessary to buy a bed. The Cradle can simply be attached to an existing bed. It eliminates the present cost of turning patients at least every two hours (twelve times per day). The task of turning is no longer needed. Due to labor savings by nurses turning patients, not only should hospital costs drop but Medicare and other insurance burden should be reduced since costly bed sores and other complications will be eliminated.

In accordance with another embodiment of the invention there is provided a pump which is well adapted for use as a component in the Cradle. The pump includes a housing defining a pair of parallel cylinder bores. The cylinder bores are positioned in a side by side relationship. Each cylinder bore is provided with a closed end which will at least partially define a chamber. The housing further at least partially defines a crankshaft-receiving borehole positioned between the parallel cylinder bores. The crankshaft-receiving borehole is directed at a right angle to the direction of the parallel cylinder bores and is spaced apart from the closed end of the cylinder bores. A pair of pistons are slidably mounted in the pair of parallel cylinder bores. A pumping chamber is defined between the end of each piston and the closed end of each cylinder bore. The pistons are each provided with a transverse actuating shaft-receiving borehole. An actuating shaft connects the pair of pistons for coordinated movement and is slidably mounted in the actuating shaft-receiving boreholes in the pistons. The actuating shaft has a midsection and a transverse crankshaft-receiving borehole extending at least partially through its midsection. A crankshaft is mounted through the housing and engages the actuating shaft. The crank shaft portion of the crankshaft is rotatably positioned in the crankshaft-receiving borehole in the actuating shaft. The drive shaft portion of the crankshaft is rotatably positioned in the crankshaft-receiving borehole of the housing. Rotation of the crankshaft causes the pistons to reciprocate causing fluid to flow into or out of the pumping chambers. The design of the pump assures constant fluid flow and constant patient motion when used in combination with the other features of the invention. When the pump is coupled with a slave cylinder for extending and retracting the bedlegs which is sized so that one cycle of the pistons in the pump chamber will drive the bedlegs through one complete cycle of extension and retraction, the pump can run continuously. Because the pump is not turning on and off, it does not disturb the patient. By operating the pump at a cycle period in the range of 1 minute to 120 minutes, the motion provided to the patient is too subtle to be unduly distracting, but sufficiently rapid to prevent bedsores. Because the cycle time is so slow, only a small motor need be used to drive the pump, and power consumption is low, less than the power draw of a light bulb.

BRIEF DESCRIPTION OF THE DRAWINGS

FIG. 8 is a plan view of mounting device which can be used in accordance with one certain embodiment of the invention.

FIG. 9 is a plan view of the device of FIG. 8 when viewed along lines 9—9.

FIG. 10 is a view of a slave cylinder assembly embodying certain features of the present invention which is taken in partial cross section to show internal details.

DETAILED DESCRIPTION OF THE INVENTION

Figure 1:
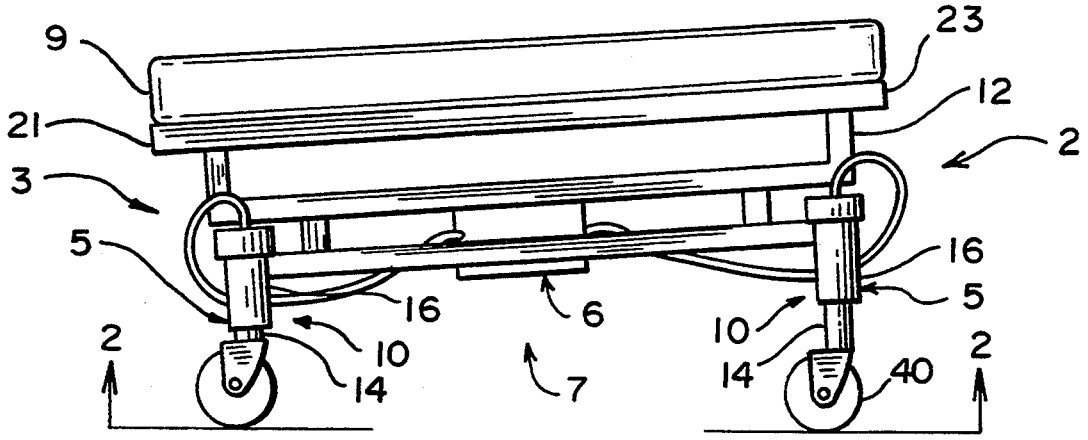
FIG. 1 is a schematic representation of an end of a hospital bed which illustrates certain features of one embodiment of the invention.
Figure 2:
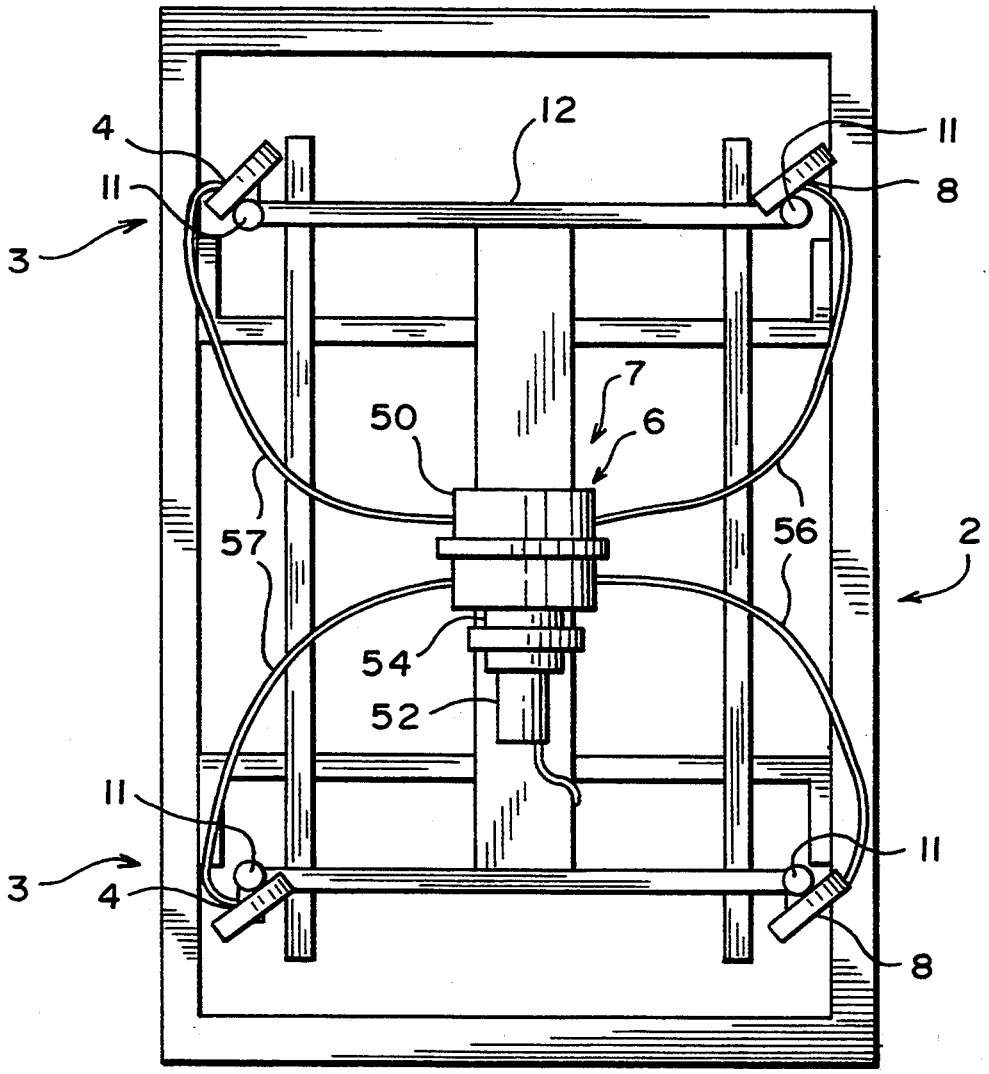
FIG. 2 is a schematic representation of the bottom side of a hospital bed when viewed along lines 2—2 of FIG. 1 illustrating certain additional features of the embodiment of the invention shown in FIG. 1.
Figure 3:
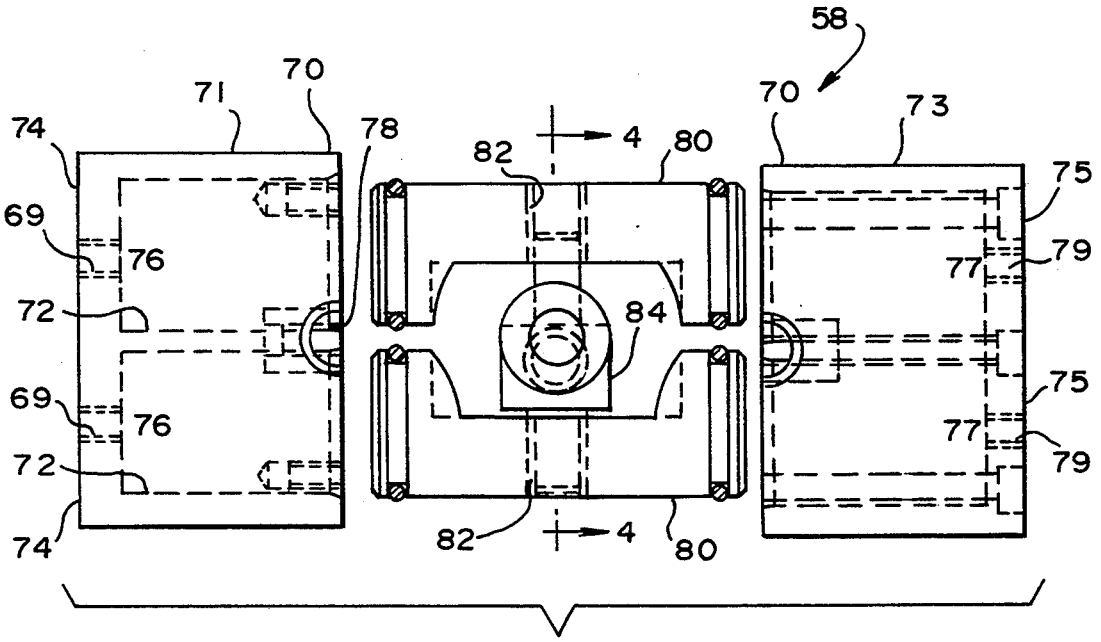
FIG. 3 is an exploded view of a pump according to one embodiment of the invention.
Figure 4:
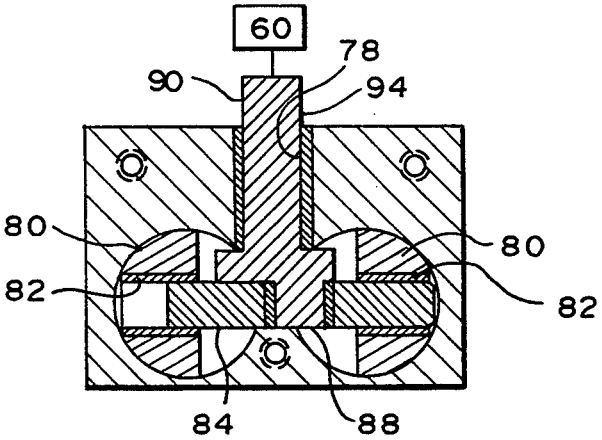
FIG. 4 is a cross sectional view of the pump in assembled form as would appear along lines 4—4 of FIG. 3.
Figure 5:
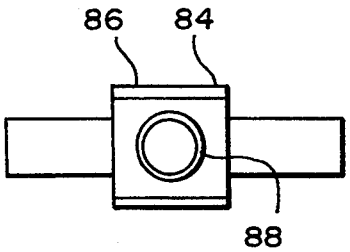
FIG. 5 is a plan view of a portion of the device shown in FIG. 3 and FIG. 4.
Figure 7:
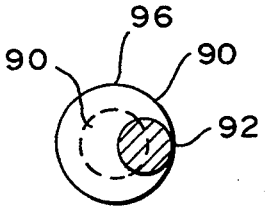
FIG. 7 is a cross sectional view of the item shown in FIG. 6 taken along lines 7—7.
Figure 6:
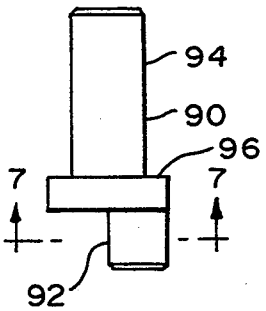
FIG. 6 is a plan view of a portion of the device shown in FIG. 3 and FIG. 4.

In a preferred embodiment, the invention is practiced with a hospital bed 2, having a bedframe 12. The bed has a first side 21 and an opposite second side 23. In this embodiment, the invention comprises a means 3 for raising and lowering one side of the bed 2 and a means 7 for repeatedly actuating the raising and lowering means 3. In one embodiment of the invention, the means 3 is formed by at least a first pair 4 of shaft drivers 5 and the means 7 is formed by a means 6 for actuating the shaft drivers. Preferably, a second pair 8 of shaft drivers is also employed. Each pair is attached to an opposite side of the bedframe 12. The bedframe 12 preferably supports a mattress 9. The bedframe 12 as found in a hospital bed will generally have four corners with generally tubularly shaped bedleg-receiving mounts 11 positioned near the corners.

The raising and lowering means 3 will generally be operable to raise and lower one side of the bed in an amount of between about 25 mm and about 300 mm, usually between about 50 mm and about 150 mm. In a preferred embodiment, the means 3 comprises a pair of shaft drivers 5 for extending and retracting the bedlegs 10. The shaft drivers are adapted for attachment to the bedframe 12. They operate to extend and retract the bedlegs and position the bedlegs in the generally vertically downward position to support the bed 2. Generally speaking, most any type of shaft driver can be used in the invention, but it must be capable of running at slow speed and must be coupled to a suitable actuator so that it will cycle slowly enough. For example, the shaft drivers can be hydraulic pistons, electric linear actuators, or screw type jacks. Hydraulic action is preferred because it is inexpensive, slow, and silent.

The actuating means 7 generally provides a cycle period in the range of about 1 minutes to about 120 minutes, usually in the range of about 2 minutes to about 60 minutes, and more preferably in the range of about 3 minutes to about 30 minutes. In a most preferred embodiment of the invention, the cycle period is in the range of about 6 minutes to about 20 minutes. The means 7 preferably includes a means 6 for repeatedly simultaneously actuating the shaft drivers. This causes the bedlegs to be extended and retracted. The shaft operated on by the shaft driver may serve as a bedleg to support the bed.

Preferably, the invention employs a pair of shafts 14 with the shaft drivers 5. The shaft drivers preferably each comprise a hydraulic ram housing 16 which at least partially defines a slave cylinder hydraulic fluid chamber 18. Each shaft 14 has a first end 20 and a second end 22 and is closely received by the hydraulic ram housing 16. The first end 20 of each shaft 14 includes means 24 for at least partially defining the slave cylinder hydraulic fluid chamber 18. In the illustrated embodiment the means 24 comprises a piston 26. The piston 26 has a mandrel 27 extending from one end which is tightly received, preferably press fitted into, a borehole 29 axially directed into the first end 20 of the shaft 14. The other end of the piston 26 is provided with a sealing means such as O-ring 31. The piston 26 is slidably positioned in a borehole 28 defined by the housing 16. The borehole 28 has a closed first end 30 and an open second end 32. In a preferred embodiment of the invention, an annular shoulder 34 in the borehole faces the closed first end 30 and is spaced apart from the closed first end 30. The annular shoulder 34 is preferably positioned near the second end 32 of the borehole. A coil spring 36 is preferably positioned along the sidewall 38 of the borehole between the piston 26 and the shoulder 34 to urge the piston toward the first end 20 of the borehole. The spring helps prevent air pockets in the hydraulic lines. In a most preferred embodiment, each shaft 14 has a generally axially directed borehole 39 at its second end 22 for receiving a wheel assembly 40 (see FIG. 1). For a hospital bed, the wheel assemblies are generally casters.

In a preferred embodiment of the invention, the means 6 for actuating the shaft drivers comprises a pump 50 for pumping hydraulic fluid, a motor 52 for driving the pump, a connecting means 54 for connecting the pump to the motor, and at least one pair of hydraulic lines 56 operatively connecting the pump to the slave cylinder chamber 18 in each hydraulic ram housing 16. Generally speaking, each hydraulic line is connected to a port 57 in the hydraulic ram housing 16 by a suitable fitting not shown. The fluid conduits convey fluid back and forth between at least the first pair 4 of hydraulic ram housings and the pump 50.

In a most preferred embodiment of the invention, the pump 50 comprises a means 58 for defining at least one master cylinder hydraulic fluid chamber which is sized so that one cycle of the means 58 for defining the master cylinder hydraulic chamber will drive the pair of shafts 14 through one complete cycle of extension and retraction. In this embodiment, the connection means 54 connecting the pump 50 and the motor 52 will generally comprise reduction gearing in the form of a reduction gearbox. Preferably, the motor and reduction gearbox form an integral unit 60. As an example, suitable electric motors which can be used as the motor 52 are approximately 1/10 horsepower, approximately 1,000 rpm. A suitable pump speed is 1/10 rpm (to provide about a 10-minute cycle period). The reduction gearbox should reduce input to the pump from the output of the motor shaft in this example at a ratio of 10,000:1. Generally speaking, reduction gearing of at least 1,000:1 will be used in the invention, usually reduction gearing in the range of 3,000:1 to 30,000:1 depending on the operating speed of the electric motor 52. A motor and gear head made in Japan by Oriental Motor Co., Ltd., was tested with good results after some modification to provide a higher gear ratio.

A preferred pump used according to the invention is illustrated in FIGS. 3 through 7. The pump can be easily set up to provide two or four master cylinders. The pump includes a housing 70 defining a pair of parallel cylinder bores 72. In the illustrated embodiment, the housing is split into two halves 71 and 73. It is preferred that the two halves be identical. The cylinder bores 72 are positioned in a side by side relationship. Each cylinder bore is provided with a closed end 74 which at least partially defines a hydraulic fluid master chamber 76. The chambers 76 are connected to the fluid flow lines 56 through fittings not shown positioned in passages 69 extending through the closed ends 74 of the cylinder bores. The housing further at least partially defines a crankshaft-receiving borehole 78 positioned between the parallel cylinder bores 72. The crankshaft-receiving borehole is directed at a right angle to the direction of the parallel cylinder bores and is spaced apart from the closed end 74 of the cylinder bores. A pair of pistons 80 are slidably mounted in the pair of parallel cylinder bores 72. A pumping chamber is defined between the end of each piston and the closed end of each cylinder bore. The pistons 80 are each provided with a transverse actuating shaft-receiving borehole 82. An actuating shaft 84 extends between the pistons 80. The actuating shaft 84 connects the pair of pistons 80 for coordinated movement and is slidably mounted in the actuating shaft-receiving boreholes 82 in the pistons 80. The actuating shaft 84 has a midsection 86 and a transverse crankshaft-receiving borehole 88 extending at least partially through its midsection. Preferably, the borehole extends all the way through and carries a roller bearing assembly for long life. A crankshaft 90 is mounted through the housing and engages the actuating shaft 84. The crank shaft portion 92 of the crankshaft is rotatably positioned in the crankshaft-receiving borehole in the actuating shaft. The drive shaft portion 94 of the crankshaft is rotatably positioned in the crankshaft-receiving borehole 78 of the housing. A crank arm 96 connects the drive shaft portion with the crank shaft portion which is longitudinally and radially spaced apart from the drive shaft portion.

Rotation of the crankshaft causes the pistons to reciprocate causing fluid to flow into or out of the hydraulic fluid master cylinder chambers. The pair of hydraulic fluid lines carry the hydraulic fluid to and from the hydraulic fluid slave cylinder chambers causing the bedlegs to extend or retract, depending on the direction of piston travel in the pump.

If only one pair of hydraulic ram housings are to be used to carry out the invention, it is preferable to place extenders in the bedlegs on the opposite side of the bed sufficient to achieve leveling of the bed. Generally speaking, the hydraulic rams will have a stroke of less than about 150 mm. and the extenders should be sized to achieve equal positive and negatives slopes across the bed during extension and retraction cycles of the bedlegs.

It is preferred that two pairs of hydraulic ram housings be deployed per bed. In this embodiment, the ram housings and shafts can be identical to the embodiment where only one pair is used although the hydraulic ram stroke will generally only be one half as much. A second pair 57 of fluid conduits carry hydraulic fluid from the pump 50 to the slave cylinder hydraulic fluid chamber of the hydraulic ram housings. The pump comprises a means for defining at least two master cylinder hydraulic fluid chambers which are sized so that one cycle of the pump will drive the means for defining the slave cylinder hydraulic fluid chambers of each of the first and second pairs of the hydraulic ram housings through one cycle.

In this embodiment of the invention, the housing 70 of the pump further has a closed second end which closes a second end of the cylinder bores 72. The pistons 80 are preferably identical on each end. A second pair of hydraulic fluid master cylinder chambers 77 are defined between the pistons and the second end of the cylinder bores. In all, four chambers are formed between the pistons and the pair of boreholes. The second pair 57 of fluid conduits are connected to the chambers 77 via boreholes 79 using suitable fittings not shown.

In a preferred embodiment of the invention, the hydraulic ram housings 16 are adapted for attachment to a hospital bedframe by mounting brackets 100. Each bracket 100 is formed from a block 102 which has a first end 104 and a second end 106. A mandrel 108 extends from near the first end of the block for receipt by the generally tubularly shaped mounting bracket on the bedframe 12. A retainer, such as split retainer 110 is positioned near the other end of the bracket 100 for retaining the hydraulic ram housing. A fastener, not shown, can be located in an axial threaded borehole 112 at the end of the mandrel to fasten the mounting bracket of the bed to the mounting bracket for the hydraulic ram housing.

In use, certain aspects of the invention provide a method for maintaining complete blood circulation in a resting person by rocking the person with a rocking motion having a cycle period in the range of about 1 to about 120 minutes. Generally, this embodiment will be carried out on persons reclining in a bed. For convalescent patients, the invention will usually be employed for period of time of 480 minutes or more, often weeks. Preferably, the cycle period is in the range of from about 2 minutes to about 60 minutes and more preferably it is in the range of from about 3 minutes to about 30 minutes. In the most preferred embodiment because it has been tested with good results, the cycle period is in the range of from about 6 to about 20 minutes. This activity level of motion is not disturbing to the patient and is often enough to assure the benefits of the invention.

The degree of tilt, as measured between the plane approximately defined by the upper surface of the bed or mattress and the floor will generally always be less than about 20 degrees. Actually, the amount of tilt need be no more than about 10 degrees to achieve good results and not be disturbing to the patient nor require restraining devices. A maximum angle of rocking of less than 7.5 degrees, such as in the range of 2.5 to 7.5 degrees has been used with good results.

It is most desirable that the rocking motion is done in a continuous manner and that the cycle period be preselected and constant. The pump described hereinabove is an excellent driver to use to carry this out.

The technique described above can be carried out by raising and lowering only one side of the bed. However, it is preferred that it be carried out by simultaneously raising one side of the bed while lowering the other.

While certain preferred embodiments of my invention have been described, it is not to be construed as so limited, except to the extent that such limitations are found in the claims.

What is claimed is:

1. A method for maintaining complete blood circulation in a resting person in a mobile hospital-type bed positioned on wheels, wherein said resting person is reclining in said mobile hospital-type bed positioned on wheels and the upper surface of the bed approximately defines a bed plane, said method comprising slowly tilting said person with a cyclic quiet, continuously rolling motion having a cycle period in the range of about 1 minute to about 120 minutes, wherein said method further comprises rocking said bed from side to side for a time period of at least about 480 minutes by use of a removable portable attachment for the bed which does not restrict mobility of the bed or access to the resting person.

2. A method for maintaining complete blood circulation in a resting person reclining in a bed, wherein said bed includes a bedframe having four corners with bedlegs supporting the bedframe near the corners, said method comprising rocking said person with a continuous cyclic rocking motion having a cycle period in the range of about 2 minutes to about 60 minutes by extending and retracting the bedlegs on at least one side of the bed.

3. A method as in claim 2 wherein said bed includes a bedframe and the bed is rocked by simultaneously raising and lowering one side of said bedframe while lowering and raising the other side of said bedframe, wherein one side of the bedframe is lowered while the other side is raised and the cycle period is in the range of about 3 minutes to about 30 minutes.

4. A method as in claim 2 wherein the cycle period is in the range of about 6 minutes to about 20 minutes.

5. A method as in claim 2 wherein said rocking has a maximum displacement from the horizontal as measured by the maximum angle the bed plane makes with the horizontal plane of less than about 20 degrees.

6. A method as in claim 5 wherein said rocking has a maximum displacement from the horizontal of less than about 10 degrees.

7. A method as in claim 5 wherein said rocking has a maximum displacement from the horizontal of less than about 7.5 degrees.

8. A method as in claim 5 wherein said rocking has a maximum displacement from the horizontal which is in the range of about 2.5 to about 7.5 degrees.

9. A method as in claim 8 wherein said rocking is done in a continuous motion and said cycle period is preselected and constant.

10. Apparatus for attachment to a hospital-type bed to provide a periodic reduction in pressure on body pressure points, said hospital-type bed having a bedframe, said bedframe having four corners with bedleg receiving mounts positioned near the corners, said apparatus comprising:

(a) a means for raising and lowering one side of said bed, said means for raising and lowering comprising a pair of shaft drivers adapted for mounting on the bedleg receiving mounts of the bedframe;

and (b) a means for repeatedly actuating the raising and lowering means, each complete cycle of raising and lowering one side of said bed having a cycle period between about 1 minute and about 120 minutes in duration, said means for repeatedly actuating the raising and lowering means adapted for mounting beneath the bedframe.

11. An apparatus for rocking a bed, said apparatus comprising:

a means for raising and lowering one side of said bed, and a means for repeatedly actuating the raising and lowering means, each complete cycle of raising and lowering one side of said bed having a cycle period between about 1 minute and about 120 minutes in duration, wherein the means for raising and lowering one side of said bed comprises a first pair of shafts and a first pair of shaft drivers;

wherein each shaft driver comprises a hydraulic ram housing comprising a means for defining a slave cylinder hydraulic fluid chamber;

wherein each shaft has a first end and a second end and is closely received by the hydraulic ram housing, and the first end of each shaft includes means for at least partially defining the slave cylinder hydraulic fluid chamber of its respective hydraulic ram housing;

wherein the means for repeatedly simultaneously actuating the shaft drivers comprises a pump for pumping hydraulic fluid;

a motor for driving the pump;

a connecting means for operatively connecting the motor to the pump; and a first pair of fluid conduits operatively connecting the pump to the slave cylinder fluid chamber in each hydraulic ram housing for conveying hydraulic fluid back and forth between the first pair of hydraulic ram housings and the pump.

12. An apparatus as in claim 11 wherein the pump comprises a means for defining at least one master cylinder hydraulic fluid chamber sized so that one cycle of the means for defining the at least one master cylinder hydraulic fluid chamber will drive the first pair of shafts through one complete cycle of extension and retraction, wherein said cycle period is between about 2 minutes and about 60 minutes in duration.

13. An apparatus as in claim 12 wherein the means for defining the at least one master cylinder hydraulic fluid chamber comprises (a) a housing defining a pair of parallel cylinder bores, said parallel cylinder bores being positioned in side by side relationship with each cylinder having a closed end, said housing further at least partially defining a crankshaft-receiving borehole positioned between the parallel cylinder bores, said crankshaft-receiving borehole being directed at a right angle to the direction of the parallel cylinder bores and being spaced apart from the closed end of the parallel cylinder bores; wherein the fluid conduits are connected to the closed end of the pair of parallel cylinder bores;

(b) a pair of pistons slidably mounted in said pair of parallel cylinder bores, one piston per cylinder bore, said pistons each having a transverse actuating-shaft receiving borehole extending at least partially therethrough, a master cylinder hydraulic fluid chamber being defined between one end of each piston and the closed end of the cylinder bore;

(c) an actuating shaft having a midsection and a transverse crankshaft-receiving borehole extending at least partially through its midsection, said actuating shaft connecting said pair of pistons for coordinated movement, said actuating shaft being slidably mounted in the actuating shaft-receiving boreholes in the pair of pistons; and (d) a crankshaft having a drive shaft portion, a crank shaft portion positioned parallel to said drive shaft portion and spaced longitudinally and radially from said drive shaft portion, and a crankshaft arm connecting the drive shaft portion to the crank shaft portion, the crank shaft portion being rotatably positioned in the crankshaft-receiving borehole in the actuating shaft, the drive shaft portion being rotatably positioned in the crankshaft-receiving borehole of the housing;

so that rotation of the crankshaft causes the pistons to reciprocate, wherein the connection means for coupling the motor to the pump comprises a reduction gearbox coupling the drive shaft portion of the pump and an output shaft of the motor, wherein the motor comprises an electric motor.

14. An apparatus as in claim 11 further comprising a second pair of hydraulic ram housings, wherein each hydraulic ram housing comprises a means for defining a slave cylinder hydraulic fluid chamber;

a second pair of shafts, wherein each shaft has a first end and a second end and is closely received by the hydraulic ram housing, and the first end of each shaft includes means at least partially defining the slave cylinder hydraulic fluid chamber of the hydraulic ram housing;

a second pair of fluid conduits operatively connecting the pump to the slave cylinder fluid chamber in each hydraulic ram housing for conveying hydraulic fluid back and forth between the second pair of hydraulic ram housings and the pump;

wherein the pump comprises a means for defining at least two master cylinder hydraulic fluid chambers sized so that one cycle of the means for defining the at least two master cylinder hydraulic fluid chambers will drive the means for defining the slave cylinder hydraulic fluid chambers of each of the first and second pairs of the hydraulic ram housings through one cycle.

15. Apparatus as in claim 14 further comprising (a) a housing having a first end and a second end, said housing defining a pair of parallel cylinder bores, said parallel cylinder bores being positioned in side by side relationship with each cylinder bore having a first closed end adjacent to the first end of the housing and a second closed end adjacent to the second end of the housing, said housing further at least partially defining a crankshaft-receiving borehole positioned between the parallel cylinder bores, said crankshaft-receiving borehole being directed at a right angle to the direction of the parallel cylinder bores and being spaced apart from the closed ends of the parallel cylinder bores;

(b) a pair of pistons each having a first end and a second end slidably mounted in said pair of parallel cylinder bores, one piston per cylinder bore, said pistons each having a transverse actuating shaft-receiving borehole extending at least partially therethrough, a chamber being formed between the first and second ends of the pair of pistons and the first and second closed ends of the pair of cylinder bores;

(c) an actuating shaft having a midsection and a transverse crankshaft-receiving borehole extending at least partially through its midsection, said actuating shaft connecting said pair of the pistons for coordinated movement, said actuating shaft being slidably mounted in the transverse actuating shaft-receiving boreholes in the pair of pistons; and (d) a crankshaft having a drive shaft portion, a crank shaft portion positioned parallel to said drive shaft portion and spaced longitudinally and radially from said drive shaft portion, and a crankshaft arm connecting the drive shaft portion to the crank shaft portion, the crank shaft portion being rotatably positioned in the crankshaft-receiving borehole in the actuating shaft, the drive shaft portion being rotatably positioned in the crankshaft-receiving borehole of the housing;

so that rotation of the crankshaft causes the pair of pistons to reciprocate; wherein the connection means for coupling the motor to the pump comprises a reduction gearbox coupling the drive shaft portion of the pump and an output shaft of the motor, wherein the motor comprises an electric motor.

16. Apparatus as in claim 11 wherein each hydraulic ram housing has a closed first end, an open second end, and a generally cylindrical borehole extending toward the open second end from the closed first end, said borehole containing a generally annular shoulder facing the first end at a spaced apart distance therefrom, said housing containing a piston slidably positioned in the generally cylindrical borehole and a coil spring positioned along the wall of the borehole between the piston and the generally annular shoulder to urge the piston toward the closed first end of the generally cylindrical borehole.

17. Apparatus as in claim 12 further comprising a bed and a bedframe supporting said bed, said bedframe having four corners and generally tubularly shaped bedleg-receiving mounts near each of said four corners, and a pair of mounting brackets each having a mandrel extending from one end which is closely received by one of the generally tubularly shaped mounts on one side of said bedframe, and a retainer on the other end which retains a hydraulic ram housing, wherein each shaft has a generally axially directed borehole at its second end for accepting a wheel assembly.

18. Apparatus comprising:

(a) a housing defining a pair of parallel cylinder bores, said parallel cylinder bores being positioned in side by side relationship with each cylinder bore having a first closed end, said housing further at least partially defining a crankshaft-receiving borehole positioned between the parallel cylinder bores, said crankshaft-receiving borehole being directed at a right angle to the direction of the parallel cylinder bores and being spaced apart from the first closed end of the parallel cylinder bores;

(b) a pair of pistons slidably mounted in said pair of parallel cylinder bores, one piston per cylinder bore, said pistons each having a transverse actuating shaft- receiving borehole extending at least partially therethrough, a chamber being defined between a first end of each piston and a first closed end of the cylinder bore;

(c) an actuating shaft having a midsection and a transverse crankshaft-receiving borehole extending at least partially through its midsection, said actuating shaft connecting said pair of pistons for coordinated movement, said actuating shaft being slidably mounted in the actuating shaft-receiving boreholes in the pistons; and (d) a crankshaft having a drive shaft portion, a crank shaft portion positioned parallel to said drive shaft portion and spaced longitudinally and radially from said drive shaft portion, and a crankshaft arm connecting the drive shaft portion to the crank shaft portion, the crank shaft portion being rotatably positioned in the crankshaft-receiving borehole in the actuating shaft, the drive shaft portion being rotatably positioned in the crankshaft-receiving borehole of the housing;

so that rotation of the crankshaft causes the pistons to reciprocate.

19. Apparatus as in claim 18 wherein each of said pair of cylinder bores further has a second closed end and each piston has a second end;

wherein a chamber is defined between the second end of each piston and the second end of each cylinder bore;

wherein four chambers are defined by the pair of pistons and the pair of boreholes;

wherein the housing has passages extending through the closed ends of the boreholes to establish fluid flow paths leading from said chambers.

* * * * *